US006085940A

United States Patent [19]

Ferri, Jr.

[11] Patent Number: 6,085,940

[45] Date of Patent: Jul. 11, 2000

[54] CHEMICAL DISPENSING SYSTEM

[76] Inventor: Edward T. Ferri, Jr., 12390 Calle Celestina, Gilroy, Calif. 95020

[21] Appl. No.: 09/167,731

[22] Filed: Oct. 7, 1998

[51] Int. Cl.[7] ..... B67D 5/08

[52] U.S. Cl. ..... 222/61; 222/152; 222/394

[58] Field of Search ..... 222/152, 394, 222/61

[56] References Cited

U.S. PATENT DOCUMENTS 2,131,329 9/1938 Moore ..... 222/152
5,570,813 11/1996 Clark, II ..... 222/394

*Primary Examiner*—David J. Walczak
*Attorney, Agent, or Firm*—Peter A. Borsari

[57] ABSTRACT

A chemical delivery system for the direct delivery of a chemical from a drum to a process area comprising a pressurized tank having a pressure/vacuum lock closure, a drum containing a chemical to be dispensed housed within the pressurized tank, and a closed loop electronic feed back system for the controlled dispensing of the chemical from the drum to a process area without the use of a pumping system. The closed loop electronic feed back system monitors and controls the flow of chemical from the drum by regulating the pressure within the pressurized tank. In an alternative embodiment, a closed loop electro-pneumatic fluid control system is provided which controls or modulates a pneumatic output valve disposed between the drum and the process in order to regulate the chemical flow from the drum. In another alternative embodiment, the chemical dispensing system7 utilizes a combination of the closed loop electronic feed back system and the closed loop electro-pneumatic fluid control system for regulating chemical flow from the drum.

20 Claims, 18 Drawing Sheets

CHEMICAL DISPENSING SYSTEM

FIELD OF INVENTION

The present invention relates to a chemical dispensing system for the direct delivery of a chemical from a drum without the use of a pumping system. More particularly, the present invention relates to a chemical dispensing system for the direct delivery of a chemical from a drum which is housed in a pressurized tank by means of a closed loop feedback control system that monitors and controls the amount of chemical flow from the chemical drum by regulating the pressurization of the pressurized tank.

BACKGROUND OF THE INVENTION

In the semiconductor industry, the transferring of process chemicals, particularly high purity process chemicals, from bulk shipping containers to the process areas is a very critical and often a dangerous operation in the manufacturing of semiconductor integrated circuits. The simplest and initially most common method for transferring process chemicals was pouring the chemical from bulk containers, usually limited to one and five gallon containers. However, this method limits the size and weight of the containers, requires considerable labor and is dangerous when hazardous chemicals are involved. Another early attempt in the transfer of process chemicals was the utilization of conventional pumping and transfer devices, such as impeller or centrifugal pumps. However, these devices proved to be unsatisfactory, primarily due to the corrosive nature of the process chemicals and the need for high purity standards.

More recently, the industry has begun to develop pumping systems for use with larger and more cost effective bulk containers, typically the standard 55 gallon drum. Considerable effort has been expended in the development and refinement of semiconductor chemical pumping and delivery systems. Currently, there are primarily three basic systems being used by the industry. The first system utilizes pneumatically driven positive displacement diaphragm or bellows pumps which pump the chemical from the drum either directly to the desired process area or to a storage tank before being pumped to the process area. Although these pumps are commercially available, they are relatively expensive due the chemically resistant materials required in their construction. In addition, they require high maintenance, especially when used for pumping wafer polishing slurries, due to the corrosive and abrasive nature of these chemicals. The second system involves a pressurized dispense system wherein chemical first is pumped into a pressurized liquid tank and then is pressure dispensed from the pressurized tank to the desired process area. Currently, these systems are custom built and the pressurized tank containing the chemical require an internal chemical resistant lining. The third system relies on vacuum/pressure technology utilizing a minimum of two vacuum/pressure chambers. This is a hybrid system that necessitates the use of numerous valves and sensors, as well as extensive plumbing and controls.

The primary performance limitation of each of these pumping systems is their inability to quickly extract the chemical from the drum and to the pressure side of the pump as fast as the positive side of the pump is capable of pumping it. In other words, there are "dry lift" or self-priming limitations associated with these pumping systems because the force that creates the input pressure in these pumping systems is primarily the result of atmospheric pressure. The maximum pressure on the inlet side will always have the limitation of 14.7 psi. This problem becomes even more evident if the chemical has a high specific gravity or viscosity, or both. This problem also is true for some of the semiconductor process chemicals, especially sulfuric and phosphoric acid.

In addition to the "dry lift" problem that is inherent in the design of these chemical transfer systems, there are additional intrinsic deficiencies in these systems which become extremely critical and significant in the semiconductor industry where ultra high purity process chemicals are used almost exclusively. One such deficiency is the generation of particle contamination created by the pumping mechanisms themselves. The positive displacement pumps employed in the first two systems described above are a source of particle contamination due to the rapid flexing of the diaphragm or bellows in the pump. This continuous flexing of the diaphragm or bellows material causes mechanical degradation of the component elements and results in the release of particles into the fluid stream. An additional source of particle contamination is derived from the check valves used in these pumps; the check valves cycle at the same rate as the flexing diaphragm or bellows, and due to the abrading nature of the check valve, release particles into the fluid stream. The third above-described system of transferring chemical, which utilizes pressure and vacuum, has resulted in a reduction of some of the particle contamination problem by the elimination of the bellows of diaphragms from the pump. However, the third system still incorporates valves that open and close continuously, and as with the check valves discussed above, the same abrading problems exist that create particle contamination in the fluid stream.

A second deficiency in these systems is their inability to maintain smooth and constant flow across sensitive ultrapure filtration media utilized in the semiconductor industry. These specially designed filter membranes have a pore size filtration capability as small as 0.1 $\mu$m and are very delicate and quite expensive. Further, the filtration performance of such filters is very sensitive to fluctuations across the filter membrane. Since positive displacement pumps have extreme pressure and flow pulsating problems, they are detrimental to the filtering performance of these ultrapure filers. Surge suppressors of various designs have been developed to alleviate the problems associated with the positive displacement pumps, but do no eliminate entirely the pulsing. In addition, these surge suppressors add complexity and cost to the pumping system. The second and third prior art systems were developed primarily to resolve this flow pulsation problem. Both utilize a pressurized liquid vessel instead of a positive displacement pump to smooth the flow for filtering and final delivery. However, due to the changing level of the liquid in the vessel as the chemical is transferred, the head pressure of the liquid at the outlet is constantly changing, thereby effecting the flow across the filtering media.

A third inherent deficiency is found in the pressure/vacuum system described above which uses pressure and vacuum to transfer chemicals, this problem is associated with outgassing or boiling off of some of the liquid when the vacuum is applied to the chemical while filling its vessels. This especially is true for some of the more volatile chemicals such as alcohol and other solvent based chemicals. In addition, systems of this type, when used to continually circulate blends of chemicals such as micro-abrasive slurries used for wafer polishing, can affect the balance of the blend and suspended solids content due to higher volatile chemicals boiling off over time while leaving the solids and other chemicals behind.

Moreover, none of the prior art systems have the ability to monitor and adjust both chemical flow and pressure fluctuations in the distribution or output line. Maintaining flow and pressure is important in the output line particurlarly for micro abrasive polishing slurries used for chemical mechanical planarization (CMP). In such processes, a specific flow must be maintained in the distribution plumbing and lines in order to prevent abrasive solid particulates from settling out of suspension and accumulating in the plumbing. These slurry particles can harded in the plumbing if flow is not maintained. In addition to the flow requirements, the pressure in the distribution lines often needs to be maintained because the final dispensing of the slurry can be a timed event that requires a specific pressure to achieve a specified volume requirement at the point of use, such as the process area.

Despite the efforts of the prior art, a need still exists for a chemical dispensing system that dispenses chemical directly from a container/drum and is capable of maintaining chemical flow and/or pressure requirements within the output lines and overall plumbing system. Such a chemical dispensing system should not depend on the use of pumps or pumping systems which extract a chemical from a container/drum to a process area. In addition, such a system should minimize or eliminate inherent "dry lift" and particle contamination problems associated with pumping systems. Such a dispensing system should provide high flow capability with a pulseless and constant flow of liquid chemical directly from a standard drum. In addition, such a dispensing system also should maximize and optimize the performance of state of the art filtering media, particularly ultrapure filtration devices. Moreover, such a system should not subject the chemical to be dispensed to low pressures or vacuum, thereby reducing or eliminating outgassing, boiling off of volatile vapor or precipitation of micro-bubbles in the chemical. Finally, such a chemical dispensing system should provide means for quickly and easily regulating either the pressure in the distribution line to the chemical flow from the drum to the process area and/or provide means for quickly and easily controlling a chemical output valve disposed downstream of the container/drum.

SUMMARY OF THE INVENTION

Accordingly, it is an object of the present invention to provide a chemical dispensing system for the direct delivery of a chemical from a drum to a process area without the use of any pumps or pumping systems.

It is also an object of the present invention to provide a chemical dispensing system which provides a pulseless and constant flow of chemical from drum to process area.

It is an additional object to the present invention to provide a chemical dispensing system which provides high flow rates and high pressures of a chemical directly from a standard chemical drum or container.

It is further object of the present invention to provide a chemical dispensing system which includes means for monitoring and controlling the chemical flow from the drum to the process area.

It is yet another object of the present invention to provide a chemical dispensing system which does not subject the chemical to be dispensed to outgassing, boiling off of volatile vapors or creation micro-bubbles.

It is still an additional object of the present invention to provide a chemical dispensing system which will optimize the performance of ultrapure filtration media.

It is another object of the present invention to provide a chemical dispensing system which utilizes a closed loop feedback flow system for monitoring and controlling the chemical flow from the drum to the process area.

It is an additional object of the present invention to provide a chemical dispensing system which utilizes a closed loop feedback flow system for monitoring and controlling the pressure in the output lines and overall plumbing system.

It is another object of the present invention to provide a chemical dispensing system which utilizes a closed loop electro-pneumatic fluid flow control system for monitoring and controlling the chemical flow from the drum to the process area.

It is yet another object of the present invention to provide a chemical dispensing system for the direct delivery of a chemical from a drum to a process area, wherein the drum is housed in pressurized tank.

It is still another object of the present invention to provide a chemical dispensing system for the direct delivery of a chemical from a drum to a process area, wherein chemical flow from the drum to process area is controlled by regulating the pressure within a pressurized tank housing the drum.

It is yet an additional object of the present invention to provide a dispensing system having means to control and adjust a chemical output valve disposed downstream of a chemical drum, in order to regulate chemical flow from the drum to the process area.

It is yet a further object of the present invention to provide a chemical dispensing system having means for rinsing and flushing the drum without the use of pumps.

It is still a further object of the present invention to provide a chemical dispensing system having a vacuum associated means for re-filling the drum with chemical.

Additional objects, advantages and novel features of the invention will be set forth in part of the description which follows, and in part will become apparent to those skilled in the art upon examination of the following specification or may be learned by practice of the invention.

These and other objects of the present invention, as embodied and broadly described herein, are achieved by providing a chemical dispensing system comprising a pressurized tank which housed a chemical drum, means for dispensing the chemical from the drum to a process area and means for monitoring and controlling the chemical flow to the process area by regulating the pressure within the pressurized tank and/or controlling a chemical output valve disposed downstream of the drum.

BRIEF DESCRIPTION OF THE DRAWINGS

The present invention will be better understood with reference to the appended drawing sheets, wherein.

DETAILED DESCRIPTION

Figure 2:
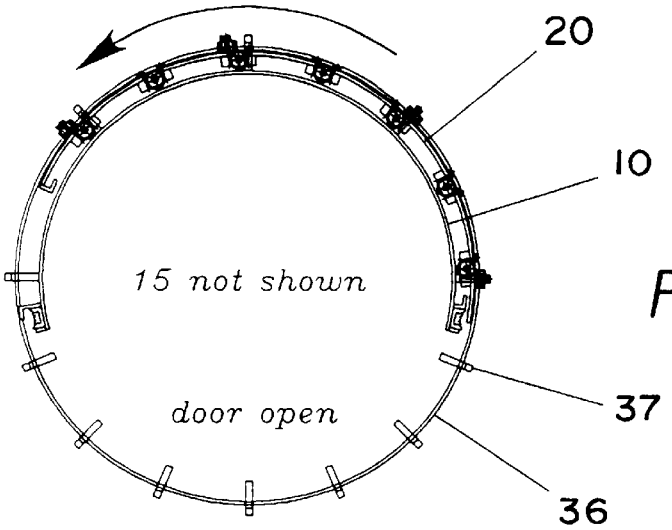
FIG. 2 is a top sectional view taken along the line A—A of FIG. 1 of the pressurized tank of the present invention when the concentric door is open.
Figure 1:
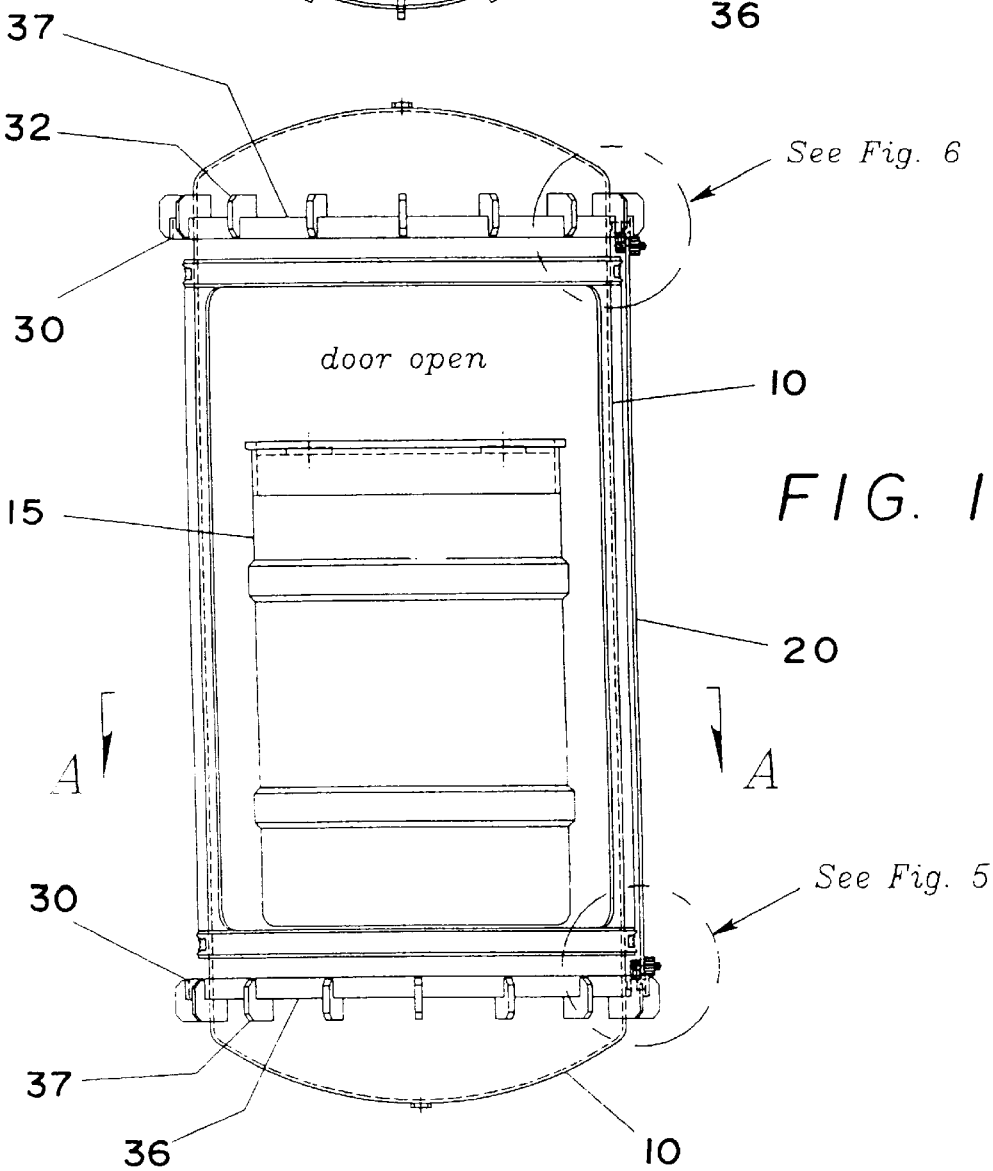
FIG. 1 is a front view of the pressurized tank of the present invention when the concentric door is open.
Figure 3:
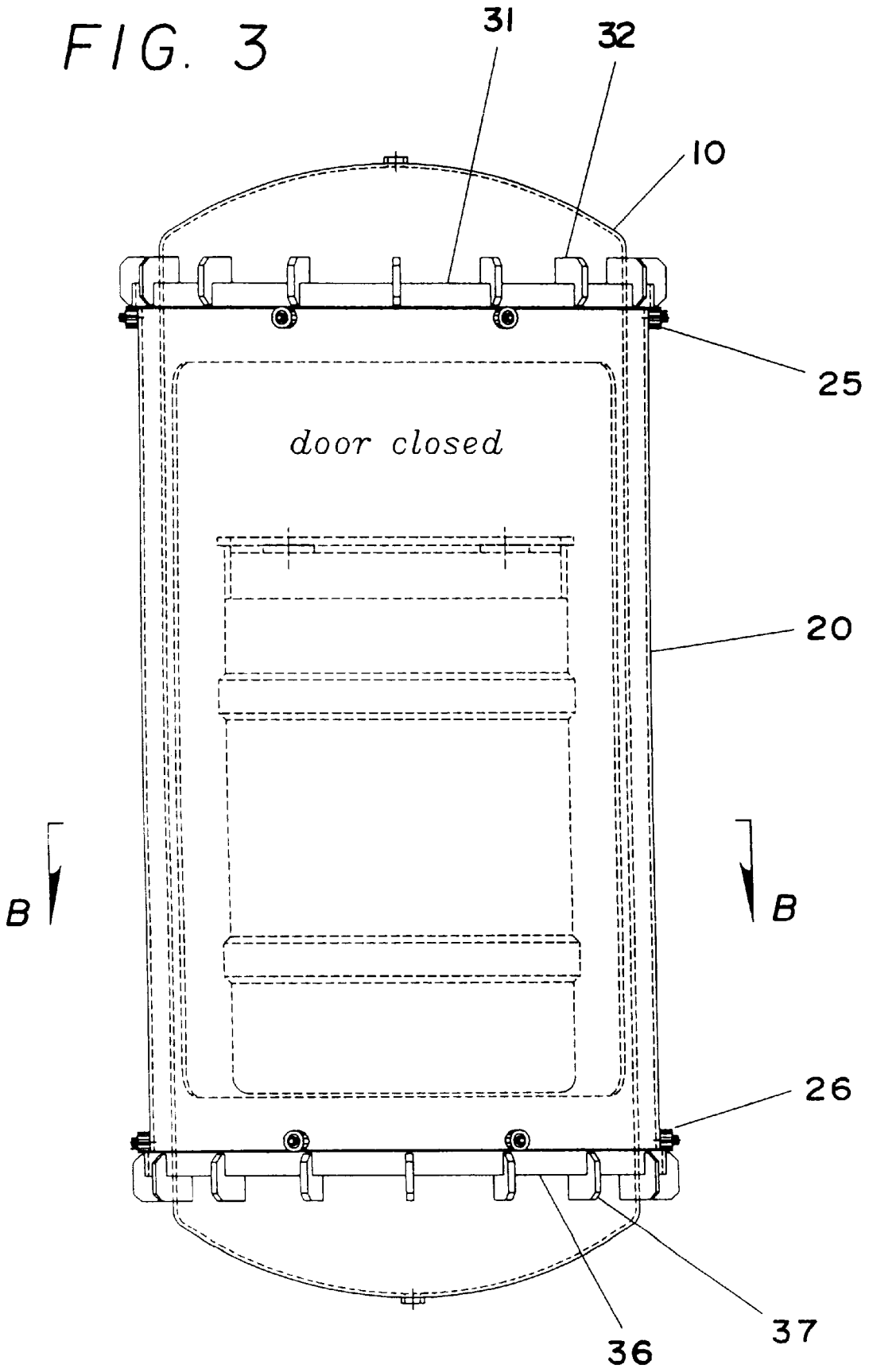
FIG. 3 is a front view of the pressurized tank of the present invention when the concentric door is closed.
Figure 4:
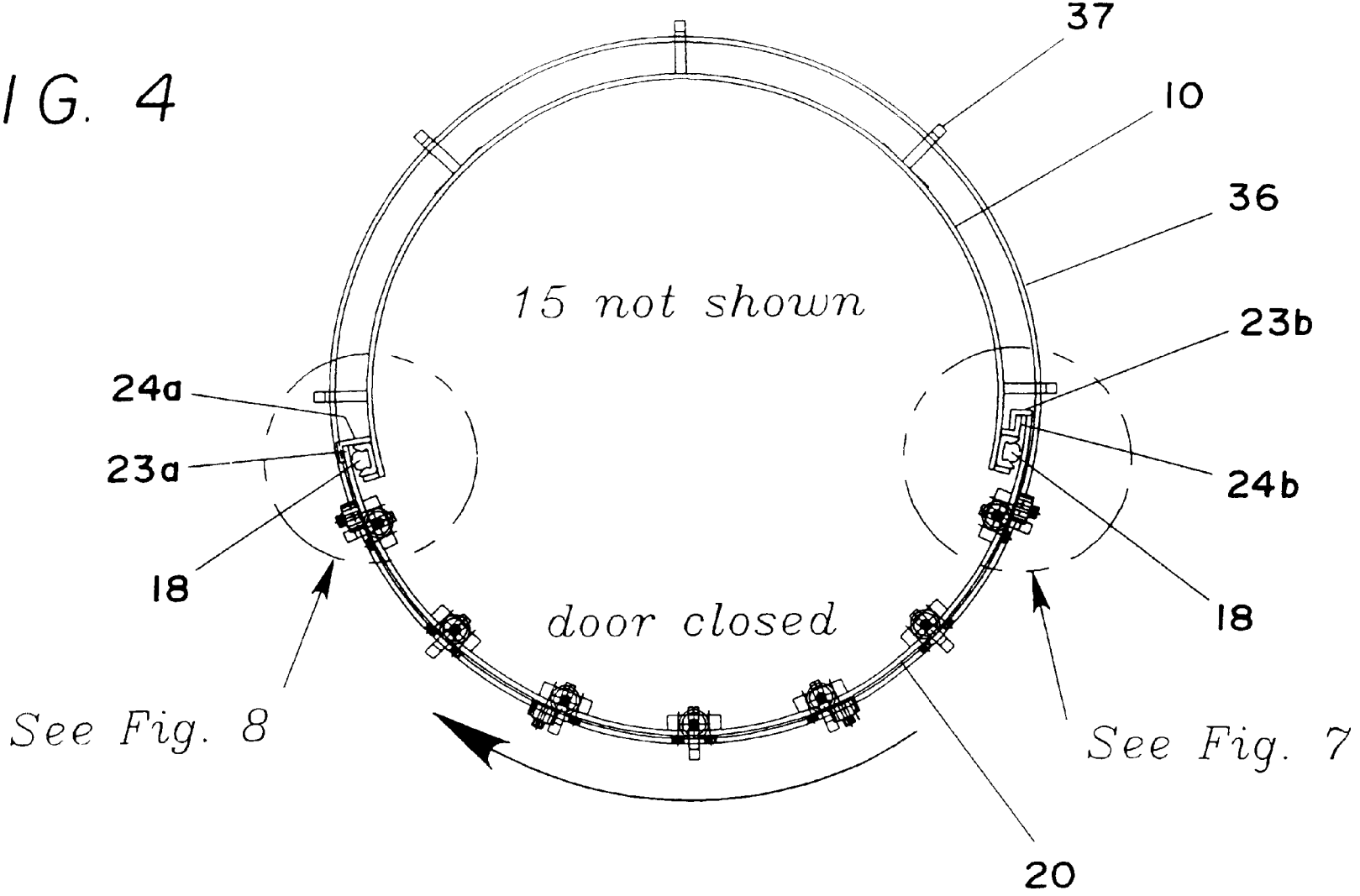
FIG. 4 is a top sectional view taken along the line B—B of FIG. 3 of the pressurized tank of the present invention when the concentric door is closed.
Figure 6:
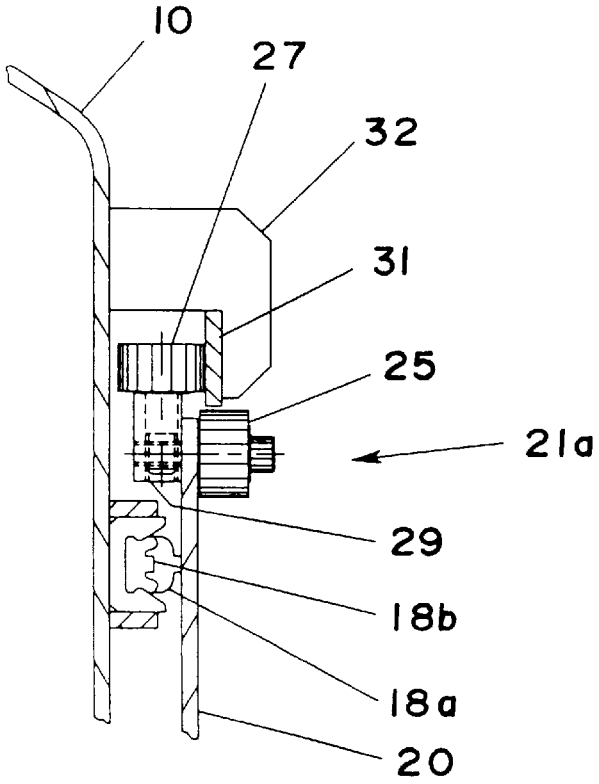
FIG. 6 is an exploded side sectional view of the detailed area of FIG. 1.
Figure 5:
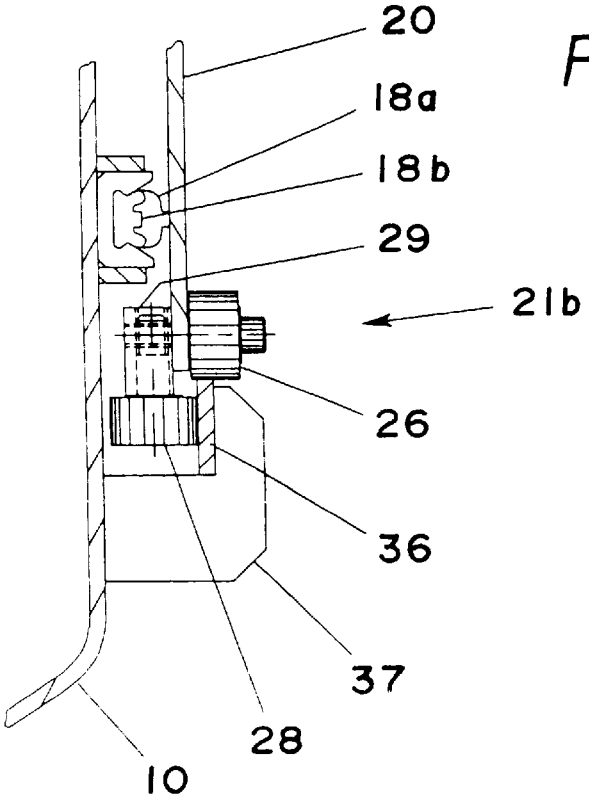
FIG. 5 is an exploded side sectional view of the detailed area of FIG. 1.
Figure 7:
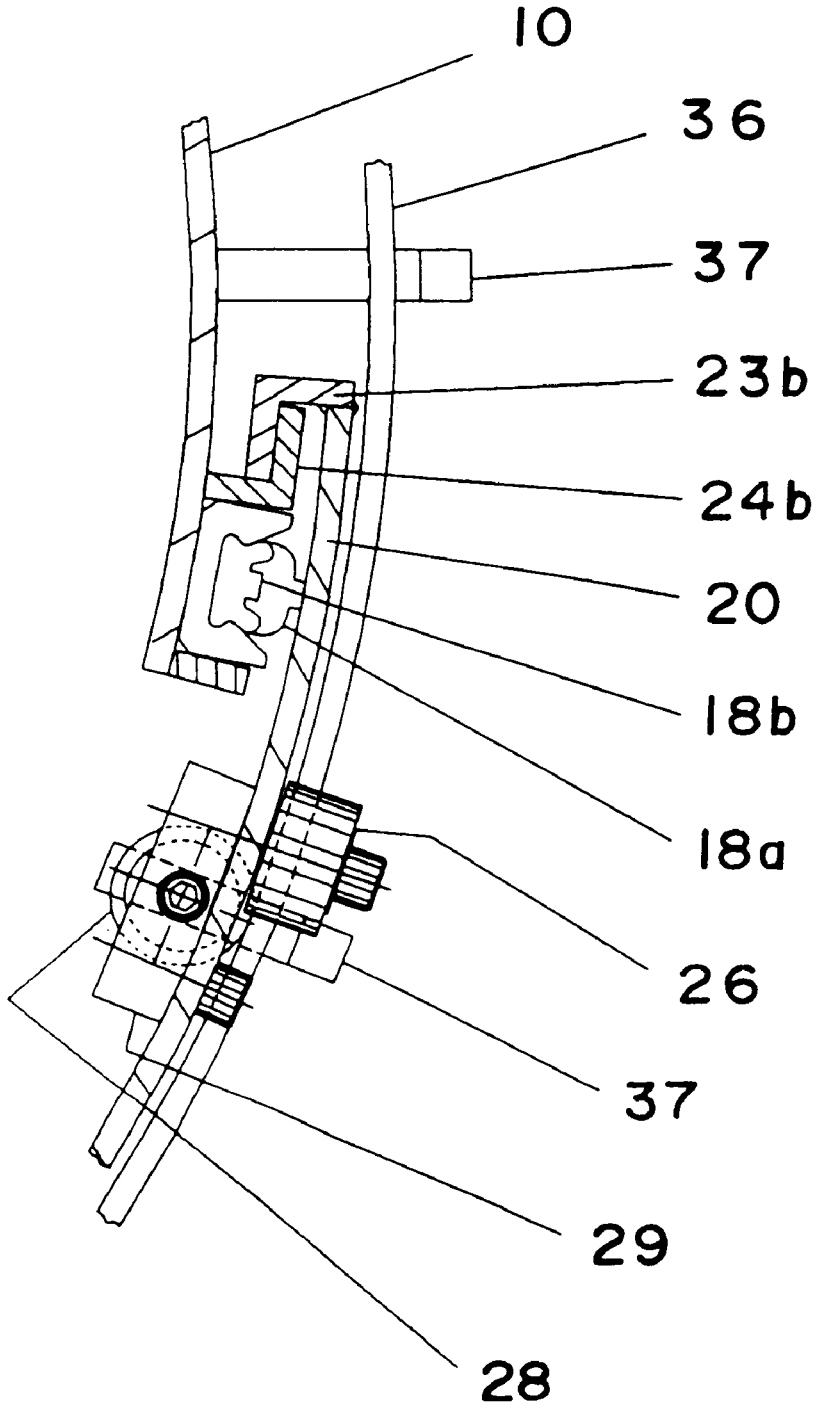
FIG. 7 is an exploded top view of a first detailed area of FIG. 4.
Figure 8:
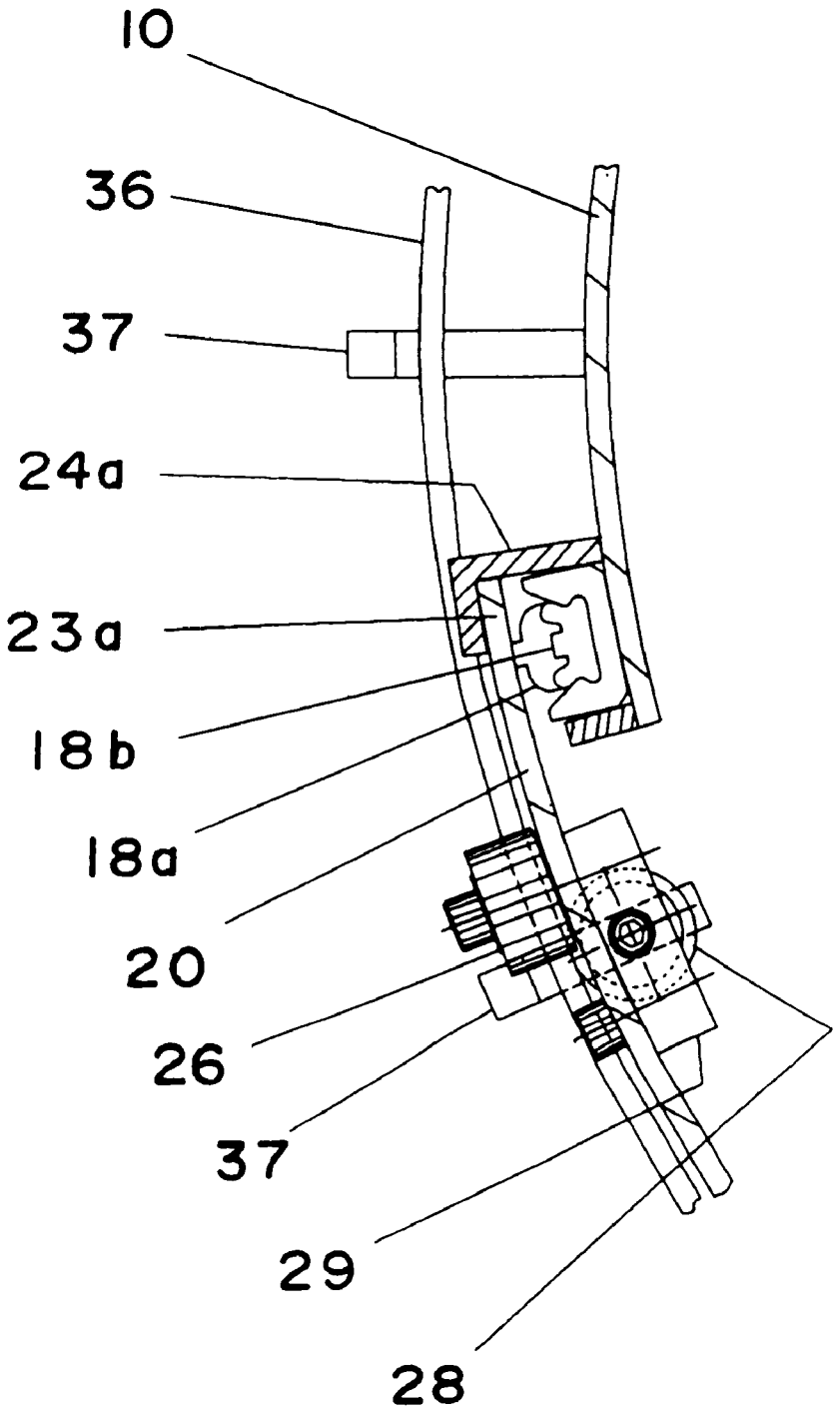
FIG. 8 is an exploded top view of the second detailed area of FIG. 4.
Figure 9:
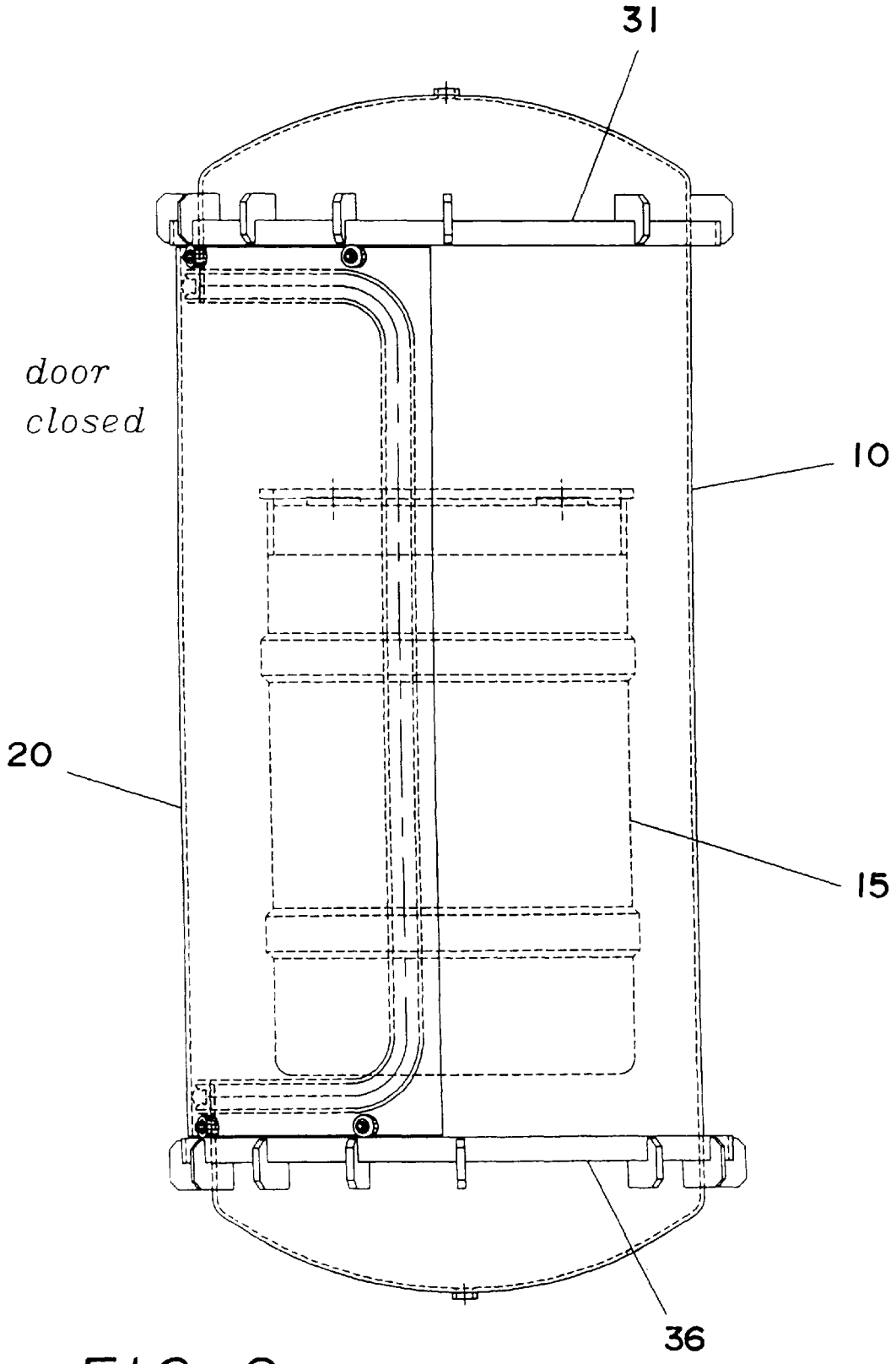
FIG. 9 is a side view of the view of the pressurized tank of the present invention when the concentric door is closed.
Figure 10:
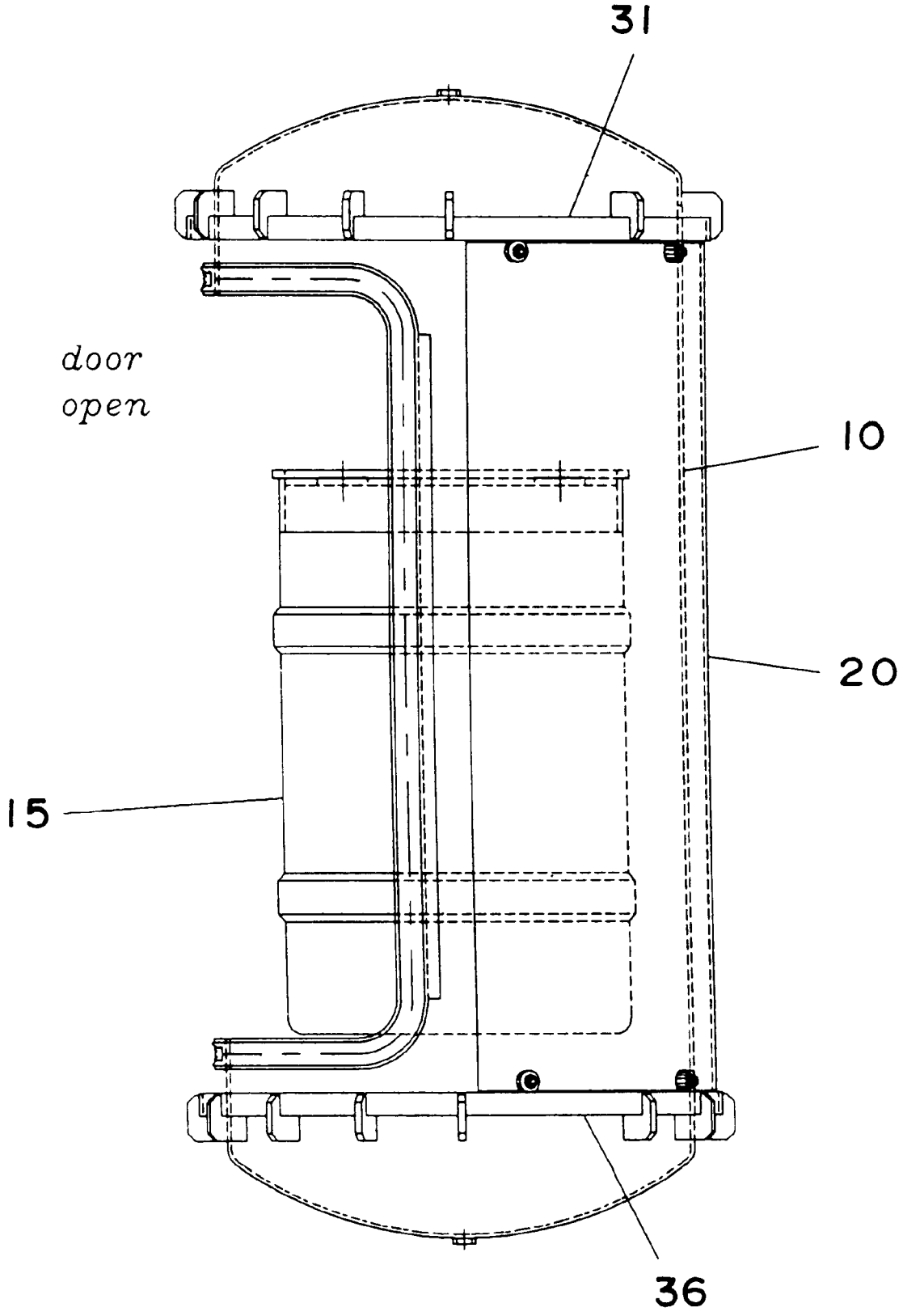
FIG. 10 is a side view of the pressurized tank of the present invention when the concentric door is open.

The present invention relates to a chemical delivery system for the direct delivery of a chemical from a drum to a process area, comprising a pressurized tank housing a drum containing the chemical to be dispensed and means for the controlled dispensing of the chemical from the drum to a process area without the use of a pumping system. More specifically, the chemical dispensing system comprises a pressurized tank having a pressure/vacuum lock closure, a drum containing a chemical to be dispensed housed in the pressurized tank and a closed loop electronic feed back system that monitors and controls the flow of chemical from the drum by regulating the pressure within the pressurized tank. The drum may be any container in which liquid chemicals are stored and delivered and does not have to be a pressurizable container. Suitable containers include for example, bulk shipping containers, for instance, the standard 55 gallon drum, as well as collapsible bladders.

The pressurized tank for holding the drum obviously must be of sufficient size to hold the drum. Referring to FIGS. 1 to 10, the pressurized tank 10 includes a pressure/vacuum lock closure comprising a curved concentric door 20 configured to conform to the curvature of the pressurized tank, a concentric guide track 30 upon which the door is mounted, thereby allowing the door to be rotated to the back side of the tank, and an inflatable seal 18 that fills the void between the door and the pressurized tank when the door is closed and the seal inflated. Concentric door 20 comprises a top portion 21*a,* a bottom portion 21*b,* a leading edge 23*a* and a trailing edge 23*b*. The concentric guide track 30 comprises an upper concentric track 31 and a lower concentric track 36. The upper concentric track 31 is secured to the pressurized tank 10 by a plurality of retainer ring mounting brackets 32 and the lower concentric track 36 is secured to the pressurized tank by a plurality of retainer ring mounting brackets 37.

Concentric door 20 is supported on the lower guide track 36 by high capacity load bearing cam followers, hereinafter referred to as door support guide rollers 26, which are mounted horizontally and radially from the center of the tank. Door 20 is retained within the upper and lower concentric tracks 31 and 36 by additional cam followers, hereinafter referred to as door retaining guide rollers 27 and 28 which are mounted vertically to the top portion 21*a* of the door (retaining guide rollers 27) and to the bottom portion 21*b* of the door (retaining guide rollers 28). The door retaining guide rollers 27 and 28 are attached to the door by suitable securing means as is well known in the art, including for example, mounting blocks 29 and extend vertically behind the upper concentric track 31 and lower concentric track 36, thereby retaining the door within the concentric track guide 30. Essentially, the support guide rollers 26 collectively function as a roller bearing when the door is being opened or closed while the retaining guide rollers 27 and 28 transfer the load created when the tank is pressurized to the plurality of retainer ring mounting brackets 32 and 37. The guide rollers 27 and 28 are positioned in such a manner that when the door is closed, they are aligned with the ring mounting brackets 32 and 37 in order to directly transfer the forces from the door to the pressurized tank 10. A plurality of horizontally and radially positioned cam followers, hereinafter referred to as upper door guide rollers 25 are secured to the top portion 21*a* of door 20 and correspond to door support guide rollers 26. Guide rollers 25 insure vertical location and positioning of the concentric door 20 but do not provide load support as do the corresponding support guide rollers 26. Of course, as will be obvious to one skilled in the art, the orientation of the concentric door can be modified to correspond to a different orientation of the tank assembly without departing from the spirit of the present invention. For instance, a tank assembly oriented horizontally would require that the concentric door be oriented horizontally. Thus, the load support for the concentric door would be modified to accommodate the different orientation of the tank assembly. Accordingly, it is to be understood that although the description above relates to a vertically disposed concentric door, differing orientations of the concentric door corresponding to differing orientations of the tank assembly are contemplated to be within the scope of the present invention.

While the guide rollers and retaining ring mounting brackets provide a means to transfer forces from the top and bottom of the door to the tank body, they do not provide means to transfer forces from the sides of door 20 (leading edge 23*a* and trailing edge 23*b*). In order to transfer the forces of pressurization from the sides of the door to the pressurized tank 10, a door stop/restraining flange is provided along the length of each side of the door; door stop 24*a* for the leading edge and door stop 24*b* for the trailing edge of the door 20. In this manner, the entire length of the leading edge 23*a* slides under door stop 24*a* and the entire length of trailing edge 23*b* slides under door stop 24*b* when door 20 is in the closed position. Once the concentric door 20 is closed, pneumatic seal 18 is inflated as shown at 18*a*. When the seal is inflated, the door 20 is pressed against these door stops and the forces from the pressurization of the tank are transferred from the door to the tank body.

Figure 11:
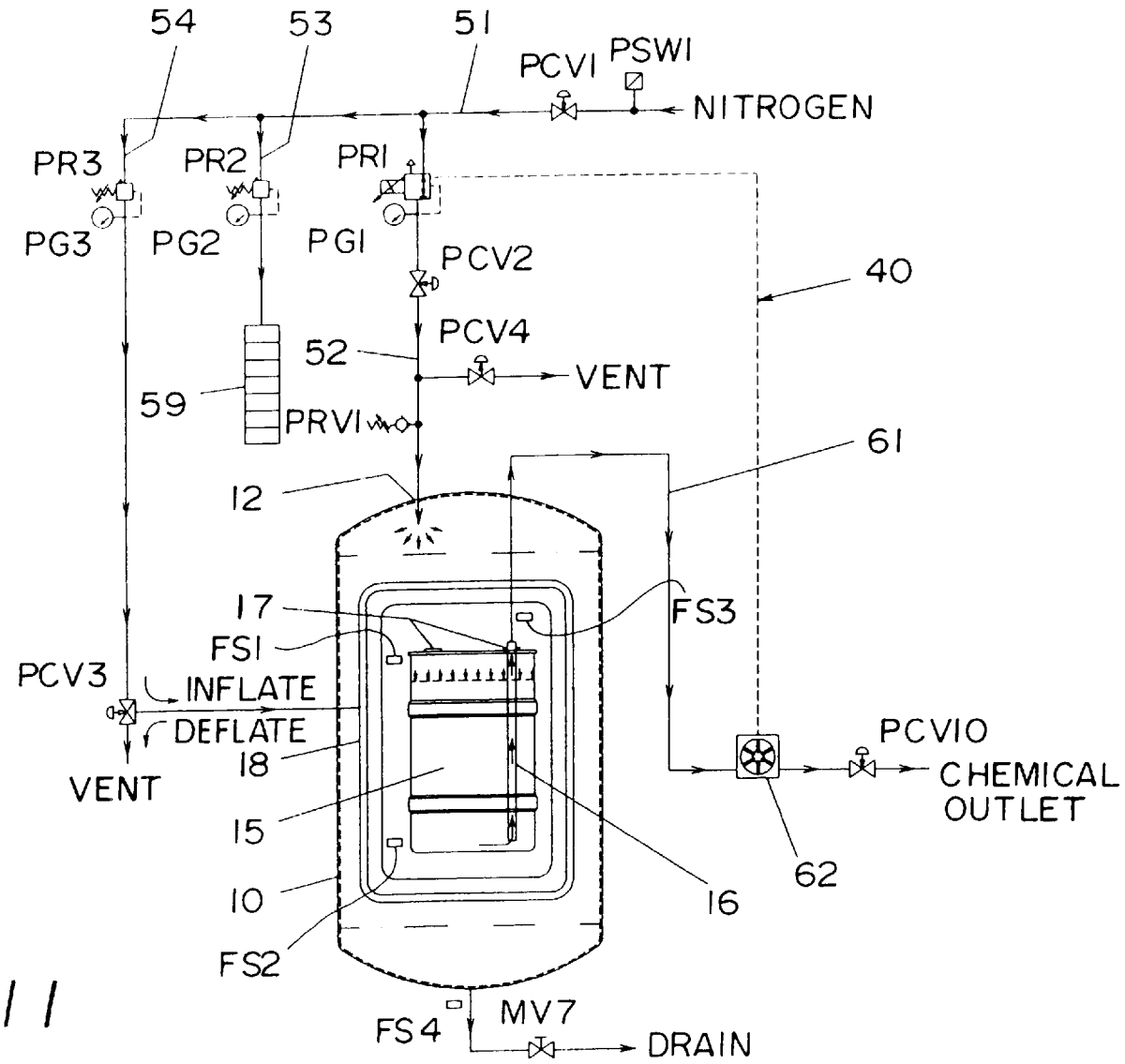
FIG. 11 is a schematic of the chemical dispensing system of the present invention.

Pressurization of the tank is required for the chemical to be dispensed from the drum to the process area. In order to pressurized the tank, a pressurizing gas, such as nitrogen, is introduced to tank 10 via inlet line 52 as shown in FIG. 11. More specifically, the pressurizing gas entering primary supply line 51 is conducted through a pressure/vacuum switch PSW1 and a pneumatic control valve PCV1 to line 52 and through a first pressure regulator PR1 which is connected to a closed loop feed back control circuit 40. A second pneumatic control valve PCV2 is provided in line 52 which when open enables the pressurizing gas to be introduced to tank 10 via inlet 12, thereby pressurizing tank 10. A pressure relief valve PRV1 may be provided in line 52 as a safety device for releasing the pressurized gas from tank 10. The pressurizing gas also is conveyed to a second pressure regulator PR2 through line 53 which controls the several pneumatic control valves (PCV's) of the system by suitable means, such as pilot valves 59, and to a third pressure regulator PR3 through line 54 for inflating the seal 18. A suitable valve means, such as 3-way control valve PCV3 is provided in line 54 for deflating seal 18 (shown deflated at 18*b*).

Once the tank 10 is pressurized sufficiently, chemical can be dispensed directly from drum 15 without the use of pumps. A dip tube 16 or similar dispensing means is provided in drum 15 which is in fluid communication with output line 61 via drum vent 17. Chemical is dispensed through the output line 61 to the requested destination (e.g. a process area) through a flow sensor 62 which also is connected to the closed loop feed back control circuit 40 and through at least one pneumatic control valve, such as PCV10 as shown in FIG. 11. Although three pneumatic control valves PCV5, PCV7 and PCV10 are shown in output line 61 in FIG. 12, it is to be understood that the number of pneumatic control valves in the output line is dependent upon several factors, including the number of other components used in the system. Optionally, the dispensed chemical may be introduced to a chemical filter 63 when high purity chemical is demanded as shown in FIG. 12.

The closed loop electronic feed back system 40 controls the flow of chemical dispensed from drum 15 by regulating the pressure in the pressurized tank 10. In other words, the pressure in the tank 10 is adjusted in order to control flow. More specifically, the amount of chemical flowing through flow meter 62 is determined by the closed loop electronic feed back circuit 40. To reduce flow, the gas pressure in the tank is decreased through proportional pressure regulator PR1. To increase chemical flow, the gas pressure in the tank is increased, also by proportional pressure regulator PR1. Because no pump based system is used, high flow rates and high pressures can be obtained directly from the chemical drum 15 without the limitation of dry lift. This is a significant advantage over the prior art, particularly when dealing with high viscosity and high specific gravity chemicals and is extremely significant when chemicals are being delivered to upper levels of a facility, such as from the basement level chemical room to an upper level processing lab. In addition, because no pumps are used, the chemical delivery system of the present invention also provides for pulseless and constant flow in contrast with prior art pulsating flow of chemical which is detrimental to the efficiency and effective life of sub micron filter membranes typically used for such chemicals. The use of pulseless flow provides a much longer life for filters which is particularly important in the dispensing of high purity chemicals through filters. With the closed loop feedback flow system controlling the pressure in the tank, a precise flow and pressure can be maintained during the dispensing of a chemical. This means that the system can maintain a constant flow and pressure while it adjusts for variations in the system as the changing head (level) in the container as it empties, changing chemical demands downstream or a filter that is slowly becoming clogged.

Figure 12:
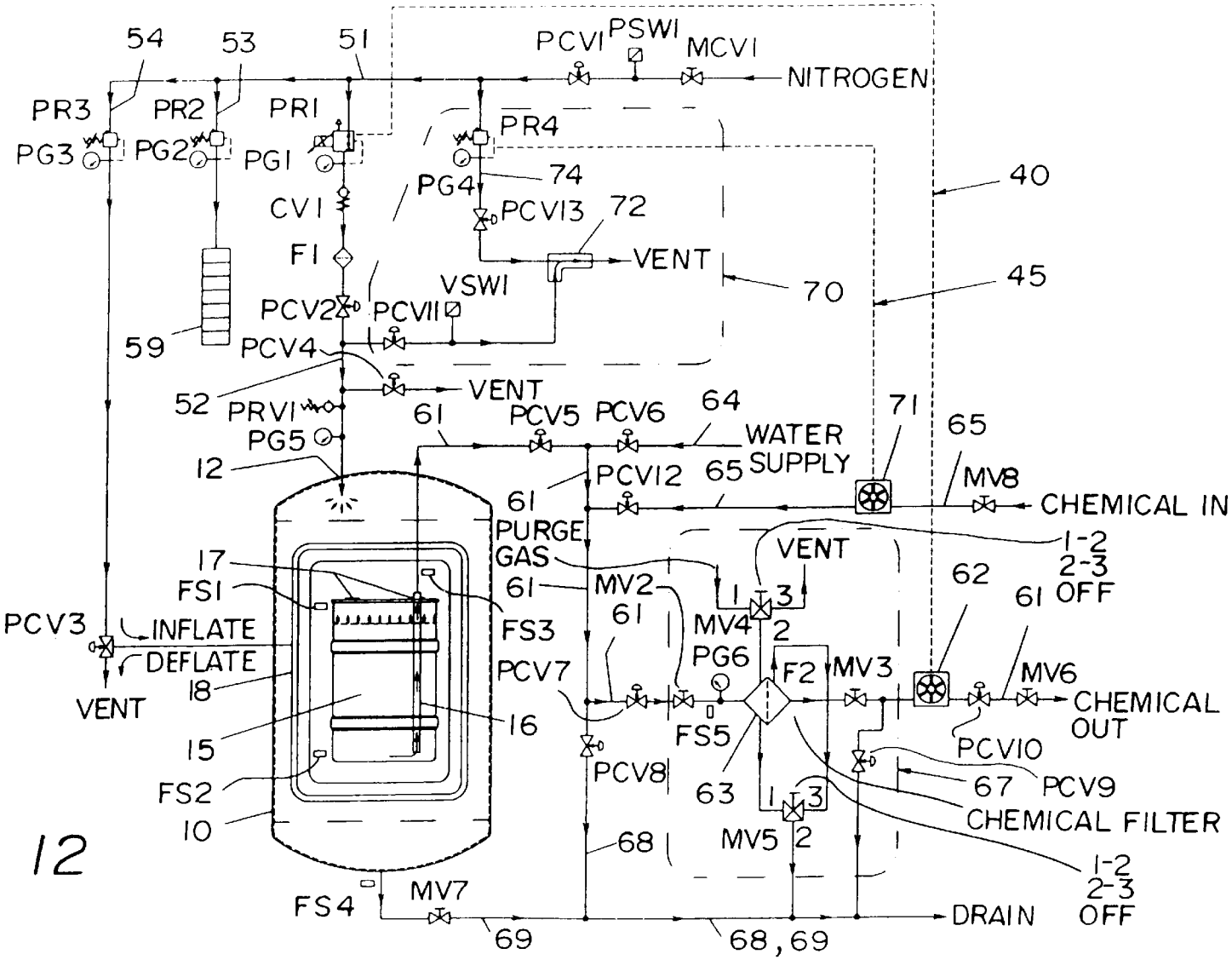
FIG. 12 is a second schematic of the chemical dispensing system of the present invention showing optional features.

The chemical dispensing system optionally may comprise several other components as shown in FIG. 12, including means, such as a drum water rinse, for periodic or final flushing of drum 15. Thus, water may be introduced to the drum through water input line 64 and pneumatic control valve PVC6 to rinse the drum. When the drum water rinse is in operation, pneumatic control valves PCV5 and PCV6 are opened and pneumatic control valves PCV7 and PCV8 are closed and water flows from line 64 through output line 61 and into the drum 15. Optionally, a nozzle or similar agitating device may be provided at drum vent 17 for spraying water into the tank 15. Following rinsing of the drum, the tank 10 is re-pressurized, pneumatic control valves PCV6 and PCV7 are closed, pneumatic control valve PCV8 is opened, and water in the drum is dispensed to a drain through output line 61 and line 68.

Optionally, the chemical dispensing system may include means to refill the drum 15 with chemical from a secondary source. Referring to FIG. 12, chemical is introduced to the system through line 65 and pneumatic control valve PCV12. In operation, pneumatic control valve PCV5 is open and all other pneumatic valves are closed, such that the chemical flows from line 65 to output line 61 and into the drum 15. It is to be understood that it is within the scope of the present invention to use any suitable means to deliver chemical to the drum 15. One means for delivering chemical to the drum is by means of a vacuum system 70, thereby eliminating the need for pumps. The vacuum system 70 comprises a second flow sensor 71 which is connected to a second closed loop feed back control circuit 45, a fourth pressure regulator PR4, also connected to the closed loop feed back control circuit 45, and a vacuum generator 72. It is to be understood that any vacuum source may be used in the present invention in order to create a vacuum within the tank. In a preferred embodiment, a vacuum generator is utilized. In operation, the vacuum generator 72 creates a vacuum in the tank 10 when pneumatic control valves PCV11 and PCV13 are opened, thereby pulling chemical from the secondary source through lines 65 and 61 and into the drum 15 through vent opening 17 and dip tube 16. The second closed loop feed back control circuit regulates the flow of chemical into the drum by controlling the pressure in line 74.

Another optional component of the chemical dispensing system is a filter flush system 67 for cleaning the chemical filter 63. The system also may include means for detecting a chemical leak within the pressurized tank 10, for example, by means of a fluid sensor FS4 positioned at the bottom of the tank. When a leak is detected, the chemical or water is conveyed through line 69 to the drain.

Figure 13:
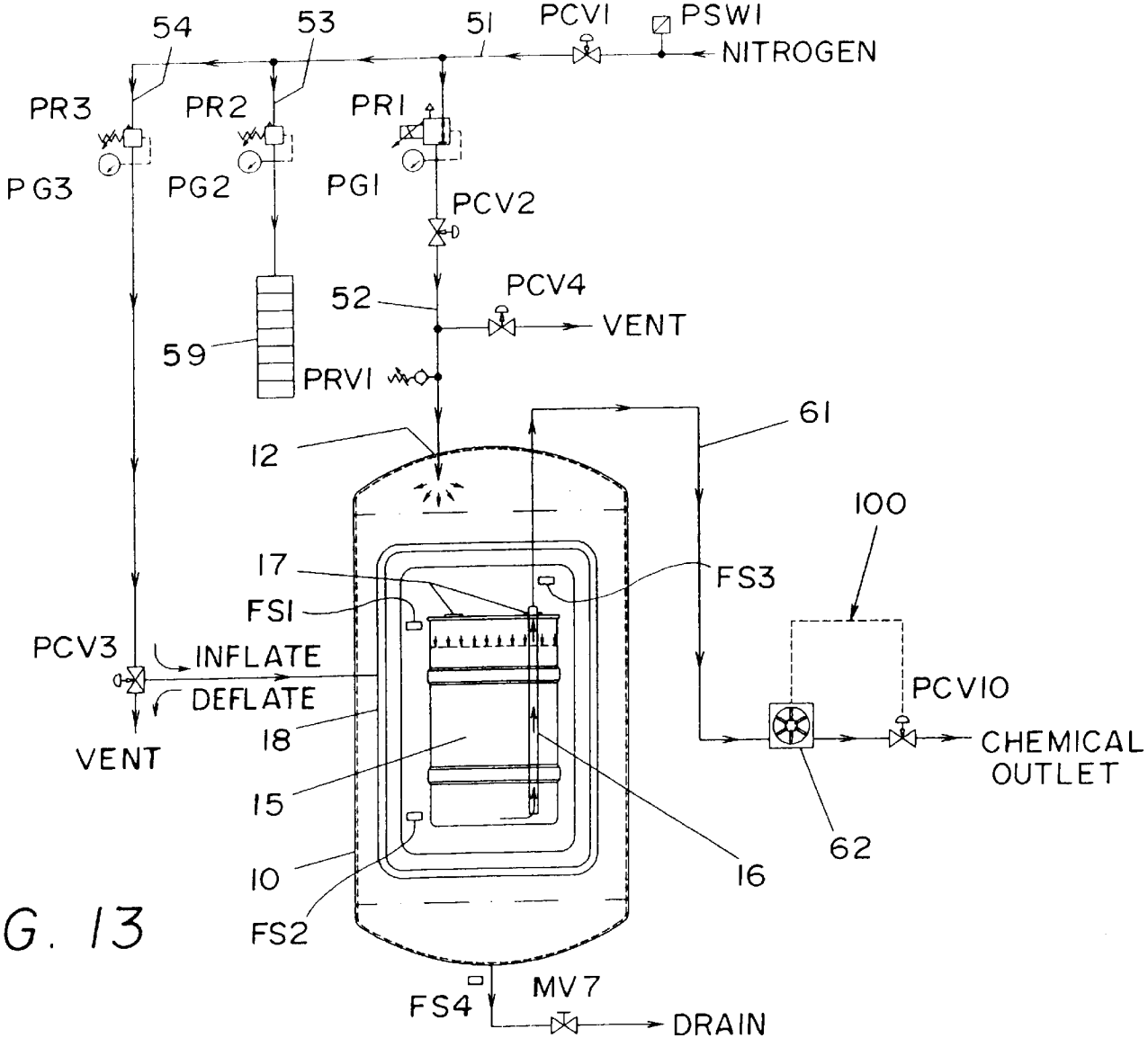
FIG. 13 is a schematic of the chemical dispensing system having a closed loop electro-pneumatic fluid flow control system of the present invention.

Rather than monitoring and controlling chemical flow by regulating the pressure within the tank, the present invention also comprises means for controlling a chemical output valve disposed downstream of the chemical drum, and preferably downstream of the flow sensor 62 as shown in FIGS. 14 to 18. More specifically, the chemical dispensing system of the present invention can utilize a closed loop electro-pneumatic fluid flow control system, generally designated 100 as shown in FIG. 13, to control a pneumatically operated valve analogous to the pneumatic control valve PCV10 shown in FIGS. 11 and 12. By controlling such an output valve, certain response time issues can be overcome which may be associated with the first embodiment in which chemical flow is regulated solely by adjusting the pressure within the tank as discussed above. In particular, to reduce flow from the direct drum, the pressure in tank 10 must be reduced by venting gas from the pressurized tank, which takes time. When a demand for increasing the flow of chemical from the direct drum is requested, the flow rate of the pressurized gas itself entering tank 10 and the compression time of the gas in the tank due to the increase pressure would be added to the response time.

Chemical flow controlling or modulating valves currently utilized in the prior art have electro-mechanical actuators. However, these valves are metal-containing and cannot be used in certain chemical transfer systems due to corrosion and high purity contamination issues, as well as due to the electric current which can be an ignition source for flammable chemicals such as solvents. The use of a closed loop electro-pneumatic fluid control system provides a significant improvement in chemical transfer systems since it enables the modulation of a non-metal output valve. The type of output valve which can be modulated by the closed loop electro-pneumatic fluid control system can be any standard off-the-shelf pneumatic diaphragm valve which is designed to be fully open or fully closed during normal operation. These type of valves are composed of corrosive resistance high purity plastic materials, including for example, Teflon™, polyvinylidenefluoride (PVDF), polypropylene, polyvinyl chloride and the like.

Five alternative closed loop electro-pneumatic fluid flow control systems have been developed and are schematically illustrated in FIGS. 14 to 18. Each of these five systems comprises a flow sensor 75 located on the chemical dispense system's output dispense line which generates an electrical output signal 76, hereinafter referred to as the feed back signal, relative to the flow that it is sensing. A servovalve control amplifier 77 monitors the feed back signal 76 and compares it to a command signal 78 that it also is monitoring from signal source generator 79. The desired signal is set by a system control computer or similar device (not shown). Based on the difference between the command signal 78 and feedback signal 76, the servovalve amplifier 77 generates a drive signal 80.

Figure 14:
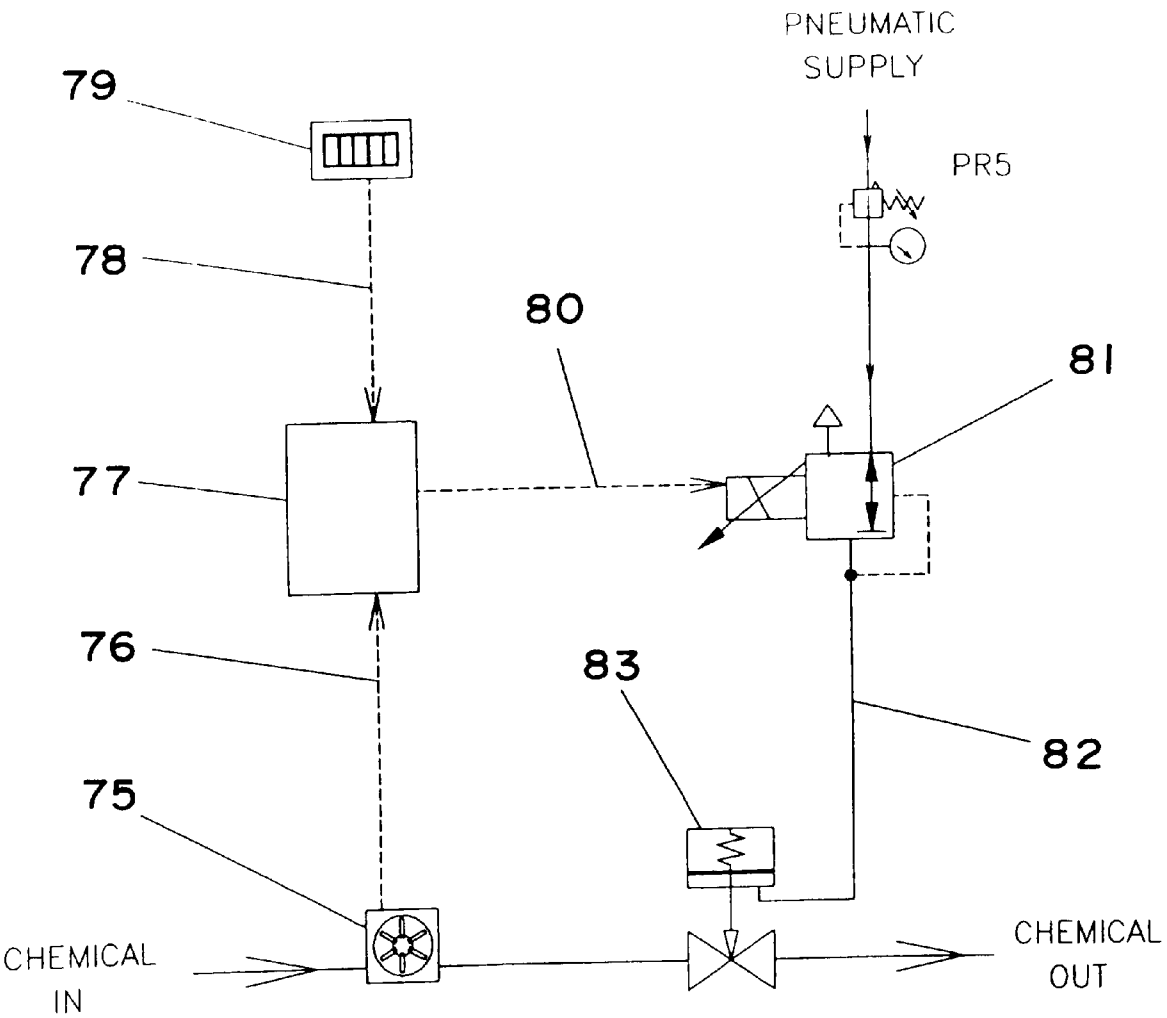
FIG. 14 is a schematic of a first embodiment of a closed loop electro-pneumatic fluid flow control system of the present invention.

In the first embodiment shown in FIG. 14, the closed loop electro-pneumatic fluid control system utilizes a proportional pressure regulator in conjunction with a pneumatically actuated diaphragm valve. In this system, the drive signal 80 is sent to a proportional pressure regulator 81 that controls the pressure of a pneumatic control signal line 82 which is connected to a pneumatically actuated diaphragm fluid valve 83 on the opposite side of the spring side of its diaphragm or actuator piston. A pneumatic pressure regulator PR5 is disposed on the other side of the proportional pressure regulator 81 and sets the maximum pressure of the primary pneumatic control signal line 82. In operation, diaphragm valve 83 is controlled by pneumatic proportional pressure regulator 81 through the pneumatic control signal line 82 by exerting an opposing pressure on the diaphragm and against the spring, and "opening" the diaphragm valve 83, thereby increasing the flow through the valve 83. When less flow is required, the pressure in pneumatic control signal line 82 is decreased, thereby exerting less pressure on the diaphragm and allowing the spring to begin to close the pneumatically actuated diaphragm valve 83, thereby decreasing the amount of chemical flow through the valve. It is to be understood that the terms "opening" or "closing" of the pneumatic actuated valve is not intended to imply that valve is either completely opened or completely closed, but rather, refers to increasing or decreasing the amount of flow capable of passing through the valve.

Figure 15:
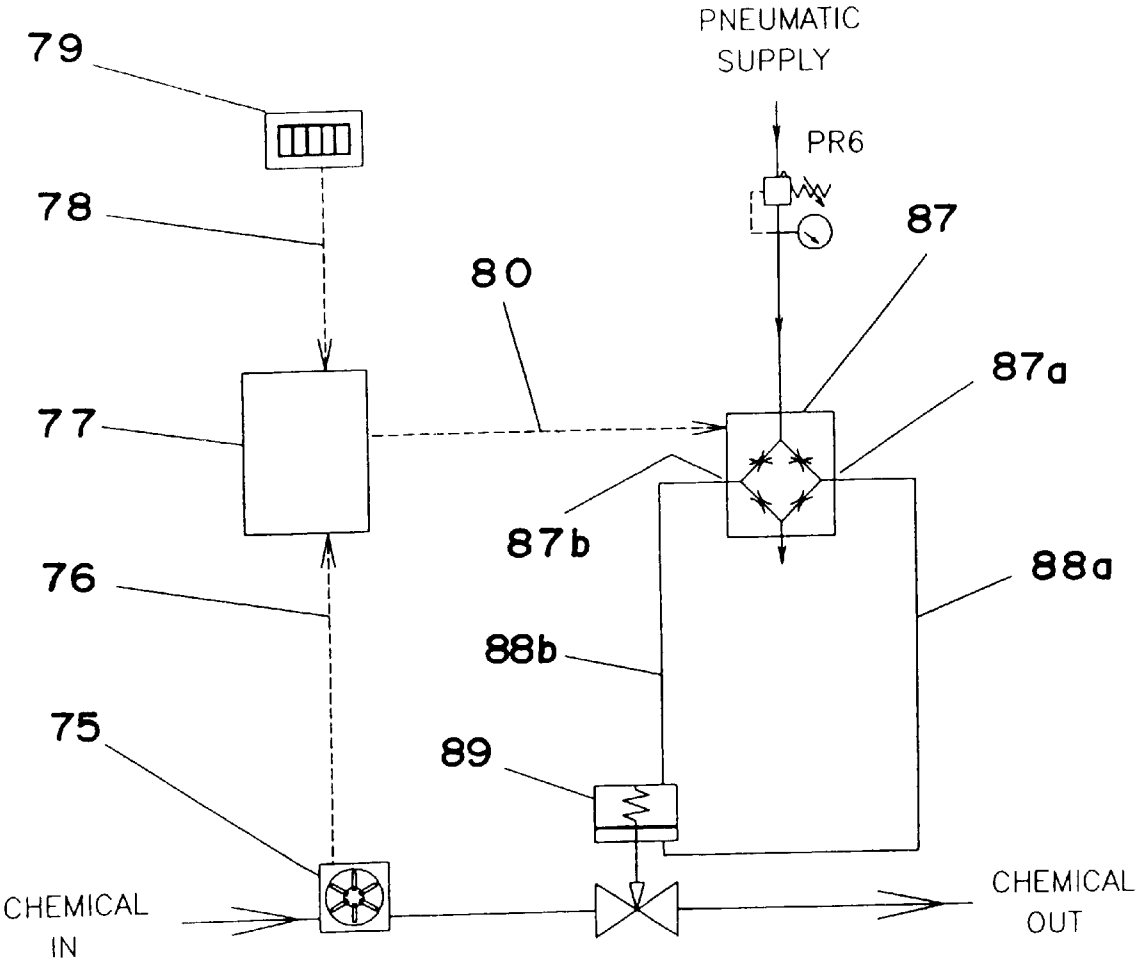
FIG. 15 is a schematic of a second embodiment of a closed loop electro-pneumatic fluid flow control system of the present invention.

The second type of closed loop electro-pneumatic fluid control system, shown in FIG. 15 utilizes a pressure divider valve in conjunction with a pneumatically operated diaphragm valve. In this system, drive signal 80 is sent to a servovalve 87 that controls the pressure of two pneumatic signal outputs 87*a* and 87*b*. These two control outputs are connected via lines 88*a* and 88*b* respectively, to a pneumatically actuated diaphragm fluid valve 89 on the opposite side of its diaphragm or actuator piston. Thus, by changing the pressure on these two control lines, the diaphragm valve can be modulated "open" or "closed" depending on the drive signal sent to the pressure divider servo valve. A pneumatic pressure regulator PR6 is disposed on the other side of the servovalve 87 and sets the initial pressure. In operation, when the system senses that additional chemical flow from drum 15 is required, the pressure in pneumatic line 88*a* is increased and the pressure in line 88*b* is decreased, thereby exerting an upward pressure on the diaphragm and "opening" the pneumatically actuated diaphragm valve 89, thereby increasing the flow of chemical through the valve 89. Conversely, when less chemical flow is required, the pressure pneumatic line 87*b* is increased and the pressure in line 88*a* is decreased, thereby exerting a downward pressure on the diaphragm and "closing" the pneumatically actuated diaphragm valve 89, thereby decreasing the amount of chemical flow through the valve.

Figure 16:
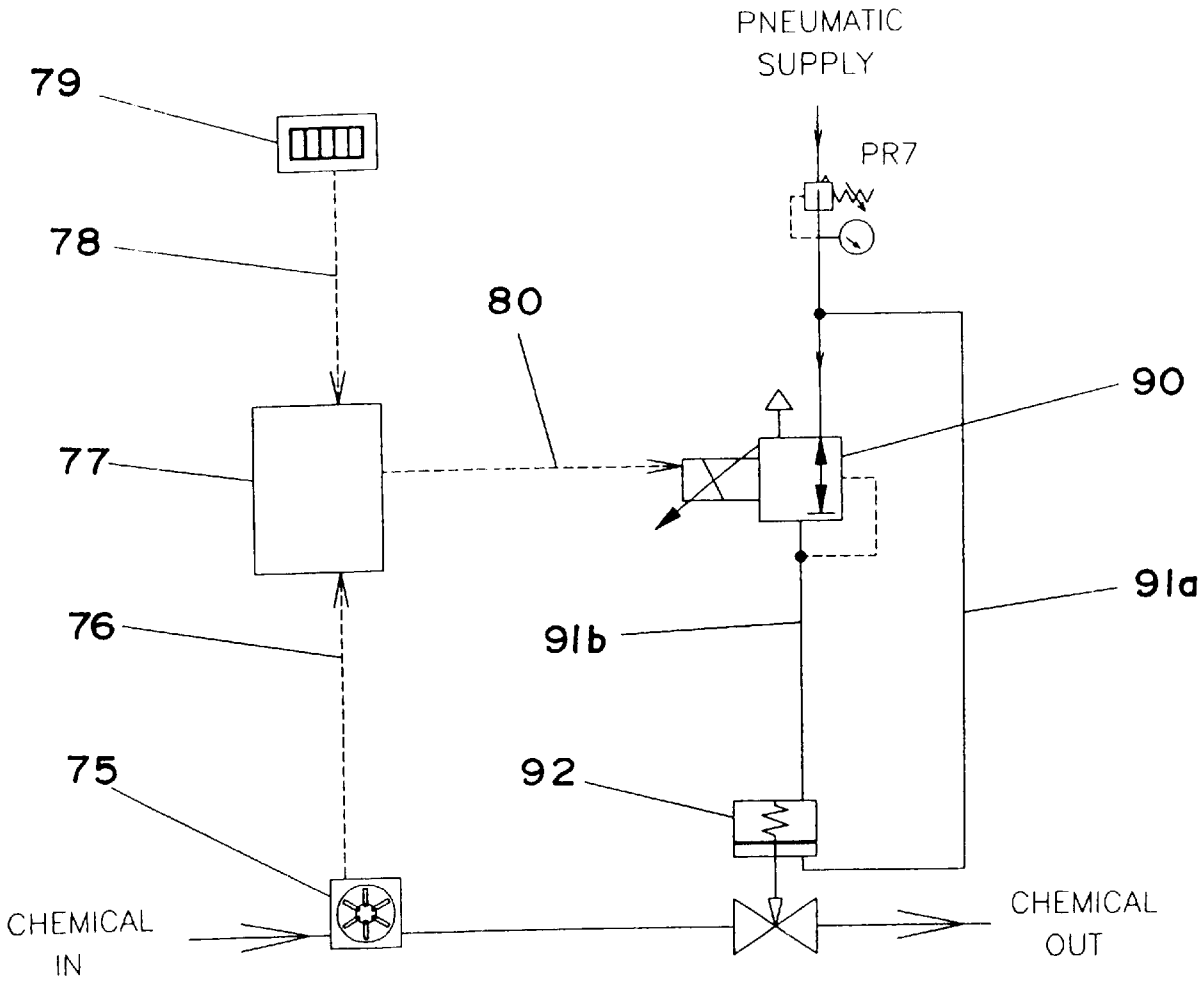
FIG. 16 is a schematic of a third embodiment of a closed loop electro-pneumatic fluid flow control system of the present invention.

Referring to FIG. 16, the third type of closed loop electro-pneumatic fluid flow control system utilizes a proportional pneumatic control signal opposing a non-proportional primary pneumatic control signal. The system differs from the previous system discussed above in that a proportional pressure regulator valve is used rather that a pressure divider servovalve. In this system, the drive signal 80 is sent to a proportional pressure regulator 90 that controls the pressure of a proportional pneumatic control signal line 91*b* which is connected to a pneumatically actuated diaphragm fluid valve 92 on the spring side of its diaphragm or actuator piston. A pneumatic pressure regulator PR7 is disposed on the other side of the proportional pressure regulator 90 and sets the initial pressure of the primary pneumatic control signal line 91*a* which is connected to a pneumatically actuated diaphragm valve 92 on the non-spring side of its diaphragm or actuator piston opposite that of line 91*b*. In operation, diaphragm valve 92 primarily is controlled by pneumatic regulator PR7 through the primary pneumatic control signal line 91*a* by exerting an upward pressure on the diaphragm and "opening" the diaphragm valve 92, thereby increasing the flow through the valve 92. When less flow is required, the flow in proportional pneumatic control signal line 91*b* is increased, thereby exerting a downward pressure on the diaphragm and "closing" the pneumatically actuated diaphragm valve 92, thereby decreasing the amount of chemical flow through the valve.

Figure 17:
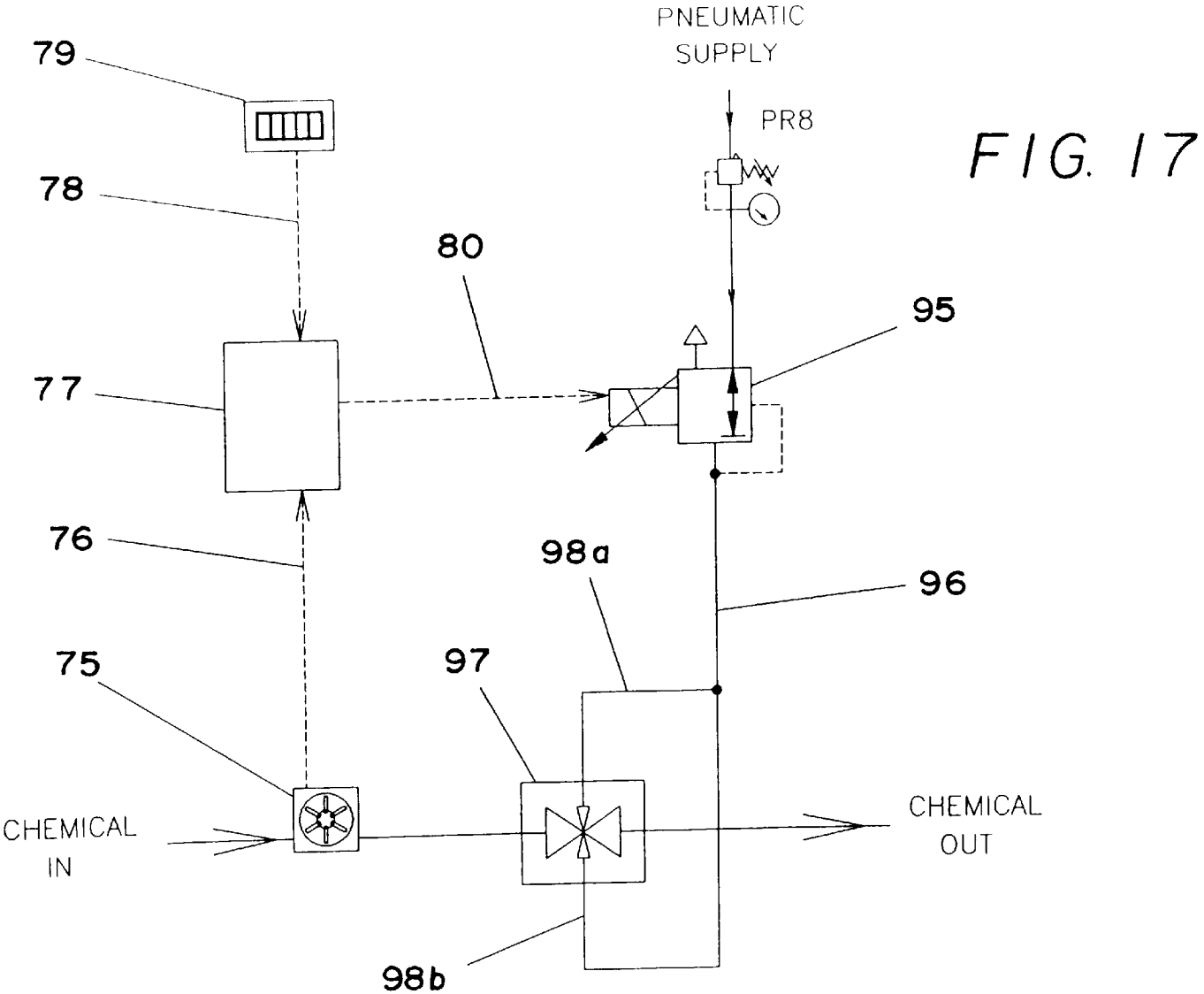
FIG. 17 is a schematic of a fourth embodiment of a closed loop electro-pneumatic fluid flow control system of the present invention.

The fourth type of closed loop electro-pneumatic fluid flow control system utilizes a proportional regulator valve in conjunction with pneumatically operated pinch valve as shown in FIG. 17. Drive signal 80 is sent to a proportional pressure regulator 95 that controls the pressure of a pneumatic control line 96 which is connected to both sides of a pneumatically actuated pinch valve 97 via lines 98*a* and 98*b*.

A pneumatic pressure regulator PR8 is disposed on the other side of the proportional pressure regulator 95 and sets the maximum pressure in the pneumatic control line 96. In operation, chemical flow opens the pinch valve 97, the higher rate of flow, the more open is the pinch valve. When less flow is required, the pressure in pneumatic control line 96 is increased, which increases the pressure in lines 98*a* and 98*b*, thereby exerting a pressure on both sides of the pinch valve's collapsible conduit (i.e. pinching the valve), and "closing" the pinch valve 97, thereby decreasing the amount of chemical flow through the valve.

Figure 18:
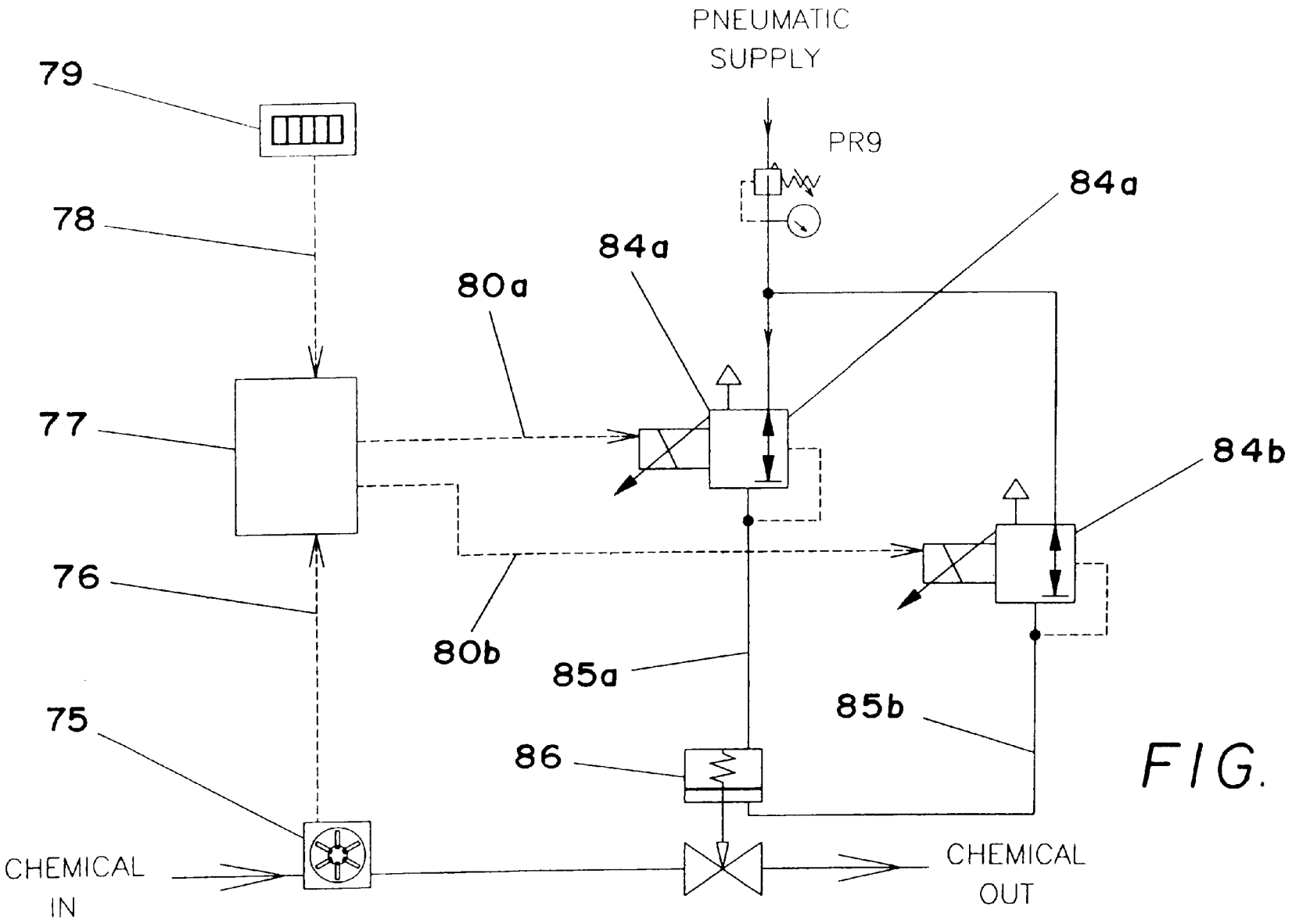
FIG. 18 is a schematic of a fifth embodiment of a closed loop electro-pneumatic fluid flow control system of the present invention.

Referring to FIG. 18, the fifth type of closed loop electro-pneumatic fluid flow control system utilizes a two proportional pressure regulators to create two opposing variable pneumatic signals. In this embodiment, the servovalve amplifier 77 generates two drive signals 80*a* and 80*b*. During normal operation, both drive signals are the same, that is they are in equilibrium. However, when a request is made for an increase or decrease in the flow rate through the pneumatic control output valve, one of the drive signals becomes the inverse of the other until the desired flow rate through the output valve has been obtained. More specifically, drive signal 80*a* is sent to first proportional regulator 84*a* and drive signal 80*b* is sent to second proportional regulator 84*b*. Proportional regulators 84*a* and 84*b* control the pressure in pneumatic control signal lines 85*a* and 85*b* respectively. These two pneumatic control signal lines 85*a* and 85*b* are connected to opposite sides of a pneumatically actuated diaphragm valve 86. A pneumatic pressure regulator valve PR9 sets the initial pressure supplied to the two proportional regulators 84*a* and 84*b*. In operation, when a decrease in the chemical flow rate through the pneumatic control output valve 86 is requested, the servoamplifier 77 generates two complementary drive signals 80*a* and 80*b*, drive signal 80*a* being sent to proportional regulator 84*a* which increases the pressure in control signal line 85*a*, thereby exerting a downward pressure on the diaphragm and "closing" the output valve 86. At the same time, drive signal 80*b* is sent to proportional regulator 84*b* which decreases the pressure in control line 85*b*, which decreases the upward pressure on the diaphragm, thereby also "closing" the output valve 86.

Figure 19:
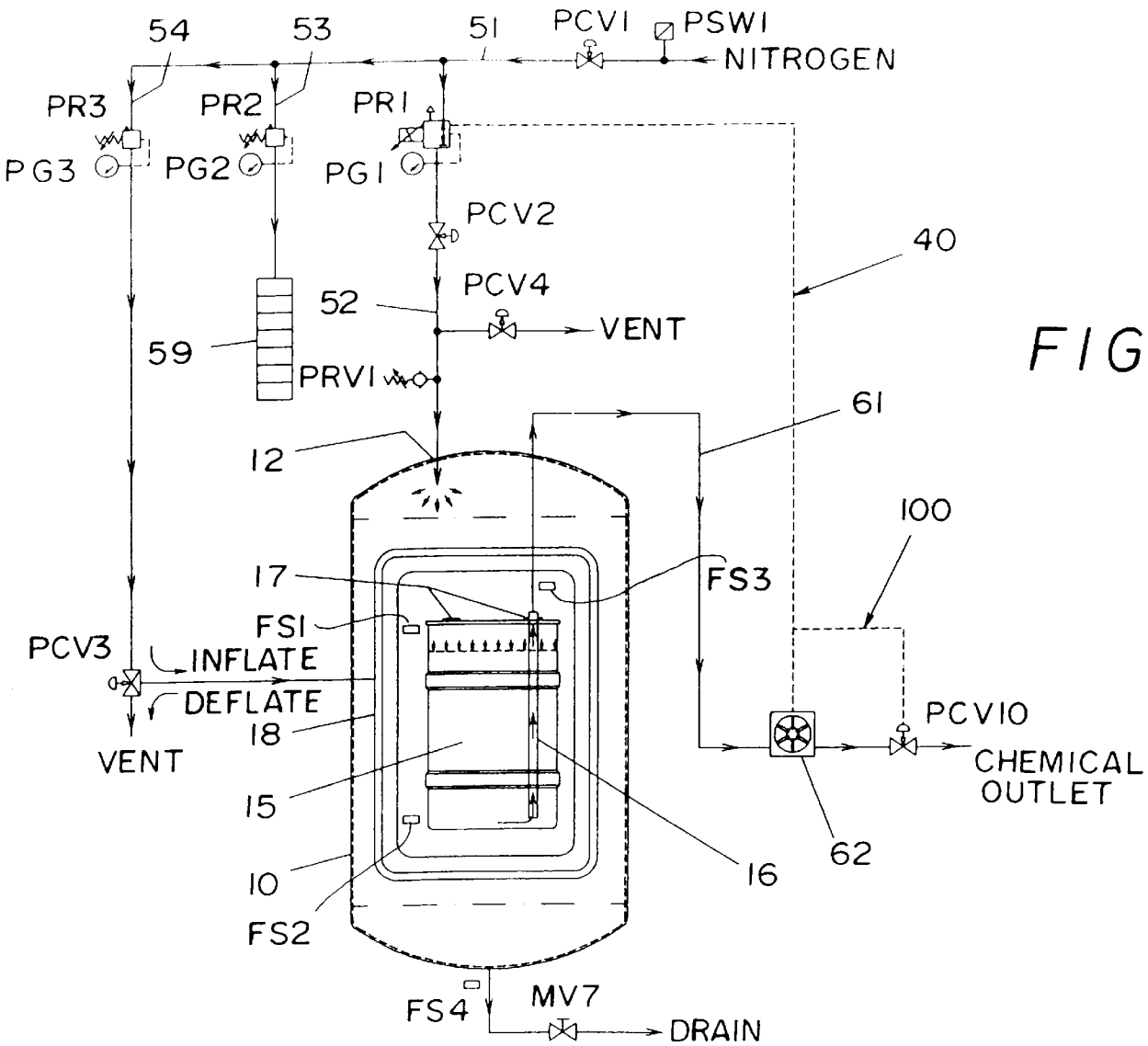
FIG. 19 is a schematic of the chemical dispensing system of the present invention utilizing the combination of a closed loop electronic feedback system and a closed loop electro-pneumatic fluid flow control system.

The present invention contemplates that chemical flow from the drum can be regulated by adjusting pressure within the tank, using the closed loop feedback circuit 40 in combination with one of the closed loop electro-pneumatic fluid flow control systems 100 for controlling a chemical output valve disposed downstream of the container/drum, as shown in FIG. 19. For example, chemical flow can be regulated generally through the closed loop feedback circuit 40 by adjusting the pressure within the pressurized tank 10 and minor adjustments to chemical flow can be attained by regulating chemical flow at the output valve by the closed loop electro-pneumatic fluid flow control system 100.

Figure 20:
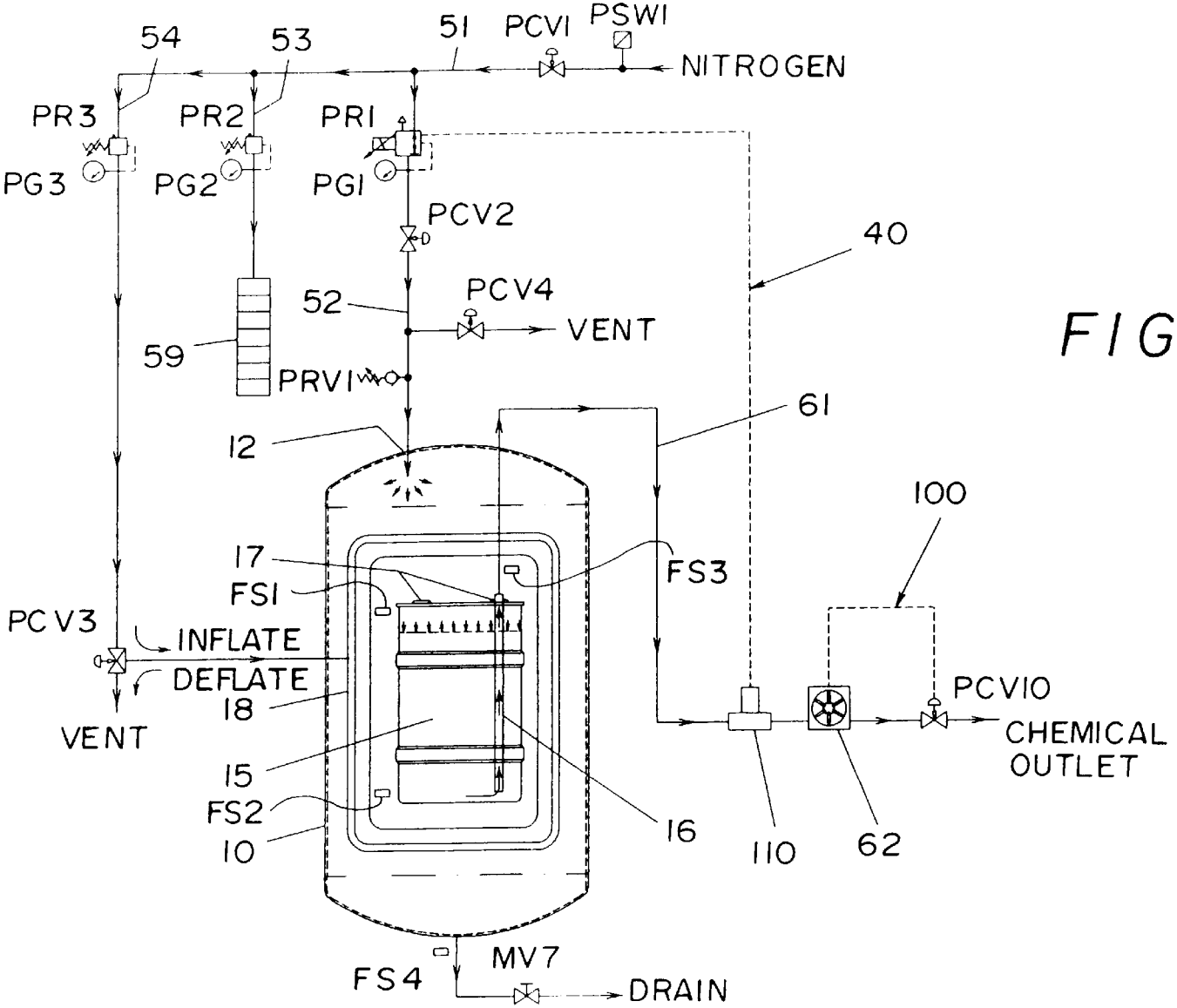
FIG. 20 is a schematic of an alternative embodiment of the present invention depicting the use of a pressure transducer to monitor and adjust pressure in the distribution output line.

In an alternative embodiment of the present invention, the chemical dispensing system provides means to regulate the pressure within the distribution output line(s) and overall plumbing system. In this embodiment, shown in FIG. 20, a pressure transducer 110 has been added to the output line, the pressure transducer being connected to the closed loop electronic feedback system 40, rather than flow sensor 62. Thus, the pressure in the output line is monitored and regulated by the close loop electronic feedback system, independently or in addition to monitoring chemical flow in the output line. When an increase or decrease in the pressure in the output line is demanded, the closed loop electronic feedback system sends a signal to the proportional pressure regulator PR1 which adjusts the pressure accordingly. In some chemical processes, maintaining pressure is required when the final dispensing of the chemical is a timed event that requires a specific pressure to achieve a specified volume requirement at the point of use.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A chemical dispensing system for the direct delivery of a chemical from a drum at a first location comprising a pressurizable tank, a drum containing a chemical housed within said pressurizable tank, and a non-pumping system for dispensing the chemical from said drum to a second location, wherein said non-pumping system includes means to monitor and control the flow of chemical from said drum by regulating and adjusting the pressure within the pressurizable tank during the dispensing of the chemical.

2. A chemical dispensing system in accordance with claim 1, wherein said non-pumping system comprises:

pressurizing means to pressurize said tank through a first pressure regulator, a first pressurizing gas inlet line and a first pneumatic control valve;

an output line in fluid communication with said drum and adapted to be in fluid communication with the second location, at least one pneumatic control output valve and a flow sensor located on said output line; and a closed loop electronic feed back control system connected to said first pressure regulator means and to said flow sensor, said closed loop electronic feed back system being capable of monitoring the flow of chemical through said output line and controlling the rate of flow of chemical by regulating the pressure within said tank.

3. A chemical dispensing means in accordance with claim 2, wherein said pressurizing means further comprises a second pressure regulator and a second pressurizing gas inlet line for controlling and regulating each of the pneumatic control valves used in the chemical dispensing system.

4. A chemical dispensing system in accordance with claim 2, wherein said pressurizable tank includes a pressure/vacuum lock closure comprising a concentric door conforming to the curvature of the tank, a concentric guide track upon which said door is mounted and which enables the door to be rotated about the outer circumference of said tank, and an inflatable seal that fills and seals the void between said tank and said door when said door is closed and said seal is inflated.

5. A chemical dispensing system in accordance with claim 4, wherein said pressurizing means further comprises a third pressure regulator and a third pressurizing gas line for inflating said seal.

6. A chemical dispensing system in accordance with claim 2, wherein a chemical filtration means is located on said output line.

7. A chemical dispensing system in accordance with claim 6, further comprising a filter flush system for cleaning said chemical filtration means.

8. A chemical dispensing system in accordance with claim 2, further comprising a drum water rinse system having a water input line in fluid communication with said output line by means of a third pneumatic control valve in such a manner that water from said water input line can be introduced to said drum.

9. A chemical dispensing system in accordance with claim 8, wherein said drum comprises spraying means connected to said output line in such a manner that water from said drum water rinse system can be sprayed into said drum.

10. A chemical dispensing system in accordance with claim 2, wherein said drum can be refilled with chemical from an outside source by means of a drum refilling system comprising a chemical refill line in fluid communication with said output line by means of a fourth pneumatic control valve in such a manner that chemical from said chemical refill line can be introduced to said drum.

11. A chemical dispensing system in accordance with claim 10, wherein said drum refilling system further includes a vacuum system comprising a second flow sensor, a fourth pressure regulator in communication with said pressurizing means and a second closed loop feed back control system connected to said second flow sensor and said fourth pressure regulator, said vacuum system being capable of creating a vacuum in said tank such that chemical is pulled from the outside source and into said drum.

12. A chemical dispensing system in accordance with claim 2, further comprising a closed loop electro- pneumatic fluid control system for modulating said pneumatic control output valve, said closed loop electro-pneumatic fluid control system being connected to said flow sensor and to a fifth pressure regulator.

13. A chemical dispensing system in accordance with claim 1, wherein said non-pumping system comprises an output line in fluid communication with said drum and adapted to be in fluid communication with the second location, at least one pneumatic control output valve and a flow sensor located on said output line; and a closed loop electro-pneumatic fluid control system for modulating said pneumatic control output valve, said closed loop electro-pneumatic fluid control system being connected to said flow sensor and to a fifth pressure regulator.

14. A chemical dispensing system in accordance with claim 13, wherein said closed loop electro-pneumatic fluid control system an electrical output signal generated by said flow sensor, a servovalve control amplifier which monitors said electrical output signal, a signal source generator which generates a command signal, said servovalve control amplifier monitoring and comparing said command signal with said electrical output signal in such as manner that it generates a drive signal which interacts with said fifth pressure regulator to modulate said pneumatic control output valve.

15. A chemical dispensing system in accordance with claim 13, wherein said closed loop electro-pneumatic fluid control system utilizes a proportional pressure regulator in conjunction with said pneumatic control output valve.

16. A chemical dispensing system in accordance with claim 13, wherein said closed loop electro-pneumatic fluid control system utilizes a pressure divider valve in conjunction with said pneumatic control output valve.

17. A chemical dispensing system in accordance with claim 13, wherein said closed loop electro-pneumatic fluid control system utilizes a proportional pneumatic control signal opposing a non-proportional primary pneumatic control signal in conjunction with said pneumatic control output valve.

18. A chemical dispensing system in accordance with claim 13, wherein said closed loop electro-pneumatic fluid control system utilizes a proportional regulator valve in conjunction with pneumatically operated pinch valve.

19. A chemical dispensing system in accordance with claim 13, wherein said closed loop electro-pneumatic fluid control system utilizes a two proportional pressure regulators to create two opposing variable pneumatic signals in conjunction with said pneumatic control output valve.

20. A chemical dispensing system for the direct delivery of a chemical from a drum at a first location comprising a pressurizable tank, a drum containing a chemical housed within said pressurizable tank, and a non-pumping system for dispensing the chemical from said drum to a second location, wherein said non-pumping system comprises pressurizing means to pressurize said tank through a first pressure regulator, a first pressurizing gas inlet line and a first pneumatic control valve;

an output line in fluid communication with said drum and adapted to be in fluid communication with the second location, at least one pneumatic control output valve and a pneumatic transducer located on said output line; and a closed loop electronic feed back control system connected to said first pressure regulator means and to said pneumatic transducer, said closed loop electronic feed back system being capable of monitoring and controlling the pressure in said output line.

* * * * *